US008814301B2

(12) United States Patent
Sano

(10) Patent No.: US 8,814,301 B2
(45) Date of Patent: Aug. 26, 2014

(54) PRINTING APPARATUS AND PRINTING METHOD

(75) Inventor: Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/193,397

(22) Filed: Jul. 28, 2011

(65) Prior Publication Data

US 2012/0026228 A1 Feb. 2, 2012

(30) Foreign Application Priority Data

Jul. 30, 2010 (JP) ..... 2010-172571

(51) Int. Cl.
*B41J 29/38* (2006.01)

(52) U.S. Cl.
USPC ..... 347/12; 347/15; 347/5

(58) Field of Classification Search
USPC ..... 347/5, 9, 12, 14–15, 43
IPC ..... B41J 2/2117,22/114
See application file for complete search history.

(56) References Cited

U.S. PATENT DOCUMENTS

| | | | | |
|---|---|---|---|---|
| 7,407,277 | B2 | 8/2008 | Yoneyama | |
| 7,562,957 | B2 | 7/2009 | Mills et al. | |
| 2003/0142168 | A1 | 7/2003 | Suzuki et al. | |
| 2005/0162451 | A1 | 7/2005 | Suzuki et al. | |
| 2009/0322814 | A1 | 12/2009 | Sano | |
| 2010/0253724 | A1 * | 10/2010 | Matsuzawa et al. | 347/12 |

FOREIGN PATENT DOCUMENTS

| | | | |
|---|---|---|---|
| JP | 2003-285427 | A | 10/2003 |
| JP | 2010-005878 | A | 1/2010 |
| JP | 2010-076216 | A | 4/2010 |

* cited by examiner

*Primary Examiner* — Lam S Nguyen
(74) *Attorney, Agent, or Firm* — Kilpatrick Townsend & Stockton LLP

(57) ABSTRACT

A controller for printing a single region in which a background image is formed by the upstream background color nozzle row and the downstream background color nozzle row or in which a color image is formed by the upstream color nozzle row and the downstream color nozzle row is printed, among regions in the transporting direction, and an overlapping region in which a background image is formed by the upstream background color nozzle row and a color image is formed by the downstream color nozzle row or in which a color image is formed by the upstream color nozzle row and a background image is formed by the downstream background color nozzle row, among regions in the transporting direction, is provided. Here, the single region and the overlapping region are switched when one medium is printed.

11 Claims, 12 Drawing Sheets

<DOUBLE-SURFACE PRINTING MODE>

PRINTING APPARATUS AND PRINTING METHOD

Priority is claimed under 35 U.S.C. §119 to Japanese Application No. 2010-172571 filed on Jul. 30, 2010 which is hereby incorporated by reference in its entirety.

BACKGROUND

1. Technical Field

The present invention relates to a printing apparatus and a printing method.

2. Related Art

An ink jet printer that performs printing by moving a head ejecting ink has been developed. Among such printers, there are those that eject, for example, white ink to form a background image and may additionally eject color ink to form a color image.

JP-A-2010-5878 is an example of the related art.

In regard of printed regions, a region where only a background image is printed and a region where a background image and a color image are printed may be present. In addition, as another combination, there may exist a region where only a color image is printed. In this case, the printing between the single region where only a background image or only a color image is printed and the overlapping region where both a background image and a color image are printed may be suitably switched between.

SUMMARY

An advantage of some aspects of the invention is to appropriately switch between so-called a single region printing and an overlapping region printing.

According to an aspect of the invention, there is provided a printing apparatus, which includes: (A) a transporting unit for transporting a medium in a transporting direction; (B) an upstream background color nozzle row in which nozzles for ejecting background ink to the medium are arranged along the transporting direction; (C) an upstream color nozzle row in which nozzles for ejecting color ink to the medium are arranged along the transporting direction; (D) a downstream background color nozzle row installed at a downstream further to the upstream background color nozzle row in the transporting direction; (E) a downstream color nozzle row in which the nozzles for ejecting color ink to the medium are arranged along the transporting direction; (F) a moving unit for moving the upstream background color nozzle row, the upstream color nozzle row, the downstream background color nozzle row and the downstream color nozzle row in an intersecting direction that crosses the transporting direction; (G) a controller for printing: a single region in which a background image is formed by the upstream background color nozzle row and the downstream background color nozzle row or in which a color image is formed by the upstream color nozzle row and the downstream color nozzle row is printed, among regions in the transporting direction; and an overlapping region in which a background image is formed by the upstream background color nozzle row and a color image is formed by the downstream color nozzle row or in which a color image is formed by the upstream color nozzle row and a background image is formed by the downstream background color nozzle row, among regions in the transporting direction, wherein the single region and the overlapping region are switched between when one medium is printed.

Other features of the invention will be apparent from the following description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
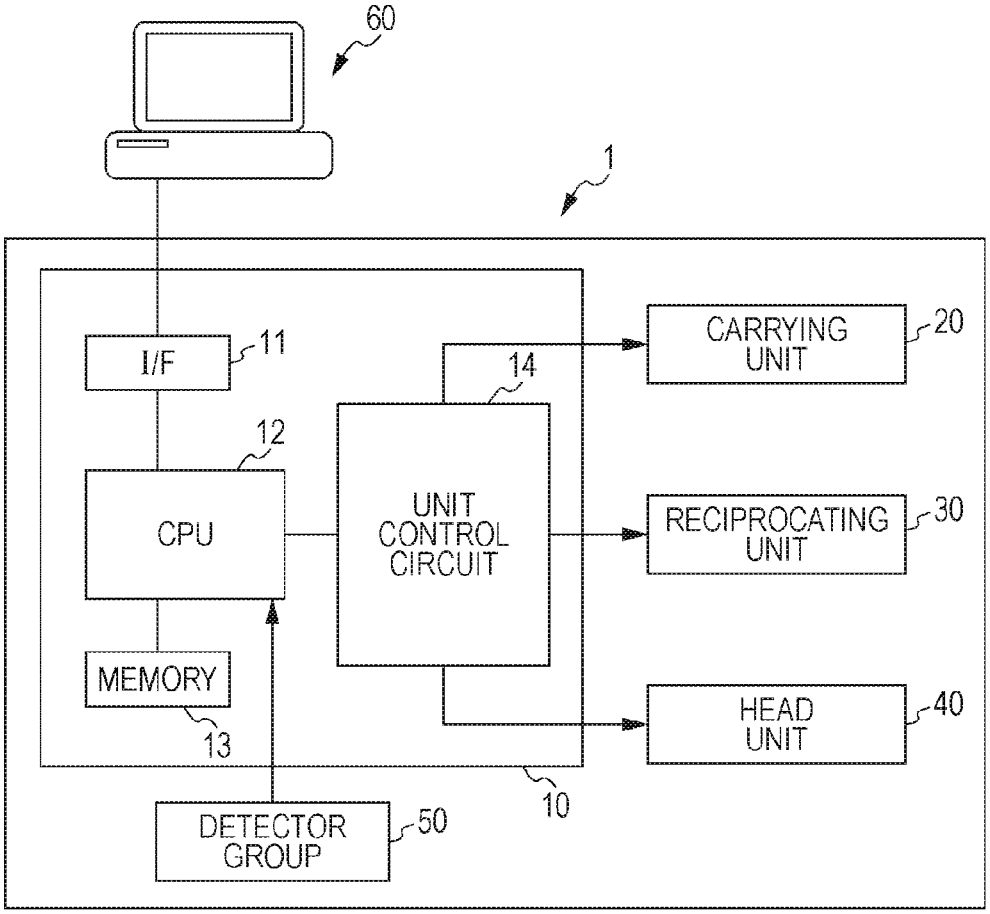
FIG. 1 is a block diagram showing an overall configuration of a printer.

The following items will be clarified through at least this specification and the accompanying drawings.

A printing apparatus, including: (A) a transporting unit for transporting a medium in a transporting direction; (B) an upstream background color nozzle row in which nozzles for ejecting background ink to the medium are arranged along the transporting direction; (C) an upstream color nozzle row in which nozzles for ejecting color ink to the medium are arranged along the transporting direction; (D) a downstream background color nozzle row installed at a downstream further to the upstream background color nozzle row in the transporting direction; (E) a downstream color nozzle row in which the nozzles for ejecting color ink to the medium are arranged along the transporting direction; (F) a moving unit for moving the upstream background color nozzle row, the upstream color nozzle row, the downstream background color nozzle row and the downstream color nozzle row in an intersecting direction that crosses the transporting direction; (G) a controller for printing: a single region in which a background image is formed by the upstream background color nozzle row and the downstream background color nozzle row or in which a color image is formed by the upstream color nozzle row and the downstream color nozzle row is printed, among regions in the transporting direction; and an overlapping region in which a background image is formed by the upstream background color nozzle row and a color image is formed by the downstream color nozzle row or in which a color image is formed by the upstream color nozzle row and a background image is formed by the downstream background color nozzle row, among regions in the transporting direction, wherein the single region and the overlapping region are switched between when one medium is printed.

In this way, so-called a single region and so-called an overlapping region may be appropriately switched between when a medium is printed.

When the overlapping region is printed, the above printing apparatus preferably has the following printing modes: a background image pre-printing mode in which the background color ink lands on the medium and then the color ink lands on the medium; and a background image post-printing mode in which the color ink lands on the medium and then the background color ink lands on the medium.

In this way, both of a case where a color image is seen from the surface of the medium and a case where a color image is seen from the opposite surface of the medium may be handled.

In addition, in the background image post-printing mode, after the background color ink lands on the medium, the color ink preferably lands on the medium further.

In this way, the double-sided printing is possible.

In addition, during the movement in the intersecting direction, ink is preferably ejected in any one of the advancing direction and the returning direction.

In this way, the single region and the overlapping region may be suitably printed. Further, the background image pre-printing mode and the background image post-printing mode may be easily switched between by performing printing in the advancing direction and in the returning direction.

In addition, the background color ink is preferably white ink.

In this way, a background image based on the white color may be formed.

In addition, the background color ink is preferably metallic color ink.

In this way, a background image based on a metallic color may be formed.

In addition, the controller preferably mixes the background color ink and the color ink to tone the background image.

In this way, it is possible to provide a color-adjusted background image.

A printing method in a printing apparatus that includes: (A) a transporting unit for transporting a medium in a transporting direction; (B) an upstream background color nozzle row in which nozzles for ejecting background ink to the medium are arranged along the transporting direction; (C) an upstream color nozzle row in which nozzles for ejecting color ink to the medium are arranged along the transporting direction; (D) a downstream background color nozzle row installed at a downstream further to the upstream background color nozzle row in the transporting direction; (E) a downstream color nozzle row in which the nozzles for ejecting color ink to the medium are arranged along the transporting direction; (F) a moving unit for moving the upstream background color nozzle row, the upstream color nozzle row, the downstream background color nozzle row and the downstream color nozzle row in an intersecting direction that crosses the transporting direction; (G) a controller for printing: a single region in which a background image is formed by the upstream background color nozzle row and the downstream background color nozzle row or in which a color image is formed by the upstream color nozzle row and the downstream color nozzle row is printed, among regions in the transporting direction; and an overlapping region in which a background image is formed by the upstream background color nozzle row and a color image is formed by the downstream color nozzle row or in which a color image is formed by the upstream color nozzle row and a background image is formed by the downstream background color nozzle row, among regions in the transporting direction, wherein the method includes determining a region where the single region printing is performed and a region where the overlapping region printing is performed, in the medium, and wherein the single region and the overlapping region are switched between based on the determination result when the medium is printed.

In this way, the so-called single region and the so-called overlapping region may be appropriately switched between when a medium is printed.

Embodiments

Hereinafter, an ink jet printer (hereinafter, a printer) which is an example of a printing apparatus and a printing system connected to the printer and a computer will be described.

Figure 2:
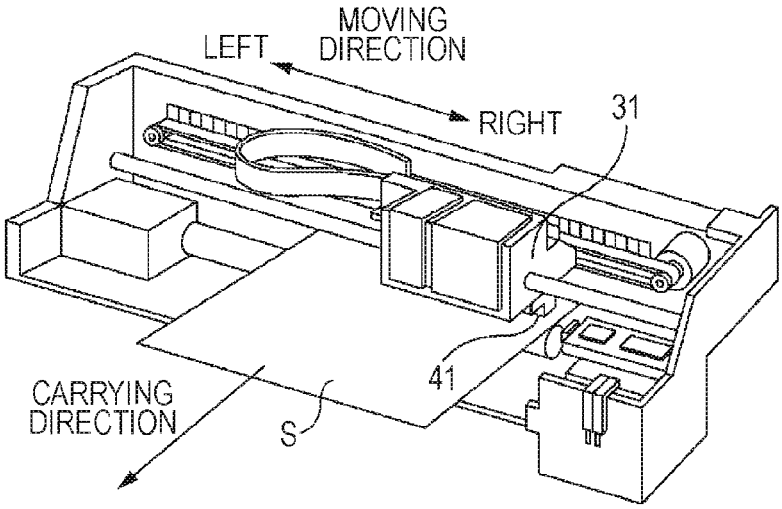
FIG. 2 is a perspective view showing the printer.

FIG. 1 is a block diagram showing an overall configuration of the printer 1. FIG. 2 is a perspective view showing the printer 1. A computer 60 is connected to the printer 1 to be capable of communicating with the printer 1 and outputs printing data to the printer 1 so that the printer 1 prints an image. In addition, a program (a printer driver) for converting an image data output from an application program to a printing data is installed to the computer 60. The printer driver may be recorded on a recording medium (a recording medium readable by the computer), such as a CD-ROM, or may be downloaded to the computer via the Internet.

A controller 10 is a control unit for controlling the printer 1. An interface unit 11 is used for transmitting and receiving data between the computer 60 and the printer 1. A CPU 12 is an arithmetic processing unit for controlling the overall operations of the printer 1. A memory 13 is used for ensuring a working area or an area for storing program for the CPU 12. The CPU 12 controls each unit via a unit control circuit 14. In addition, internal states of the printer 1 are monitored by a detector group 50, and the controller 10 controls each unit based on the detection result.

A transporting unit 20 carries a medium S to a printable location, and during a printing process, the transporting unit 20 carries the medium S in a transporting direction by a predetermined transporting amount.

A carriage unit 30 is used for moving a head 41 in a direction crossing the transporting direction, and the carriage unit 30 has a carriage 31.

A head unit 40 is used for ejecting ink to the medium S, and the head unit 40 has the head 41. The head 41 is movable in a movement direction by the carriage 31 of the carriage unit 30. A plurality of nozzles serving as an ink ejecting unit is installed at the lower surface of the head 41, and each nozzle has an ink chamber (not shown) filled with ink.

Figure 3:
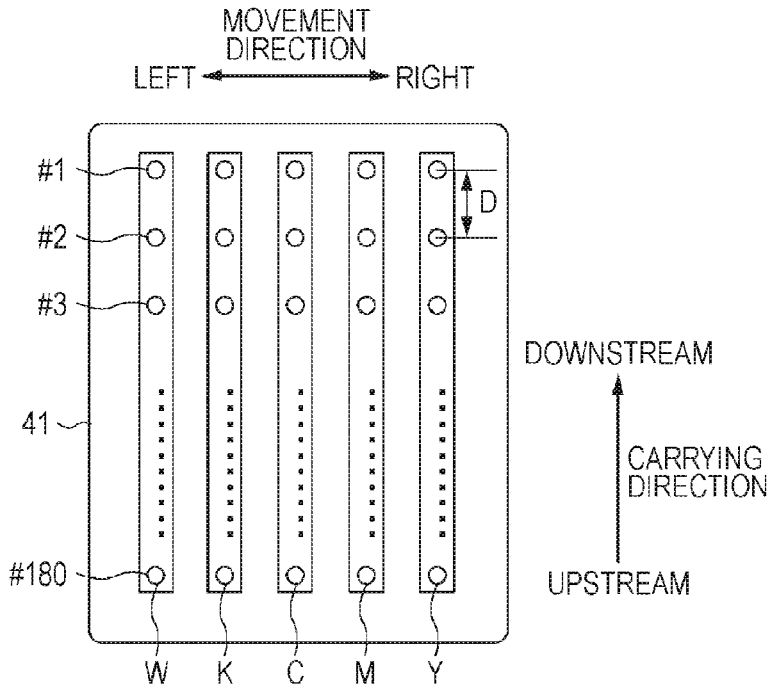
FIG. 3 is a schematic diagram showing an arrangement of nozzles installed at the lower surface of a head.

FIG. 3 shows an arrangement of the nozzles installed to the lower surface of the head 41. In addition, FIG. 3 shows the nozzles that are visually observed from the upper surface of the head 41. Five nozzle rows, each having 180 nozzles, are arranged in parallel with the transporting direction at regular intervals (nozzle pitch D). As shown in FIG. 3, a white nozzle row W for ejecting white ink, a black nozzle row K for ejecting black ink, a cyan nozzle row C for ejecting cyan ink, a magenta nozzle row M for ejecting magenta ink, and a yellow nozzle row Y for ejecting yellow ink are arranged along the movement direction. In addition, 180 nozzles in each nozzle row are numbered so that a nozzle at a downstream in the transporting direction has a smaller number (#1 to #180) in order.

In the printer 1, a dot forming process for forming dots on a medium by intermittently ejecting ink droplets from the head 41 moving in the movement direction and a transporting process for transporting the medium in the transporting direction with respect to the head 41 are repeatedly performed. In this way, dots may be formed in a later dot forming process at different locations on the medium from the locations of dots formed in the earlier dot forming process, which allows printing a two-dimensional image on the medium. In addition, one moving operation of the head 41 in the movement direction while ejecting ink droplets (one dot forming and ejecting operation) is called a "pass".

Figure 4:
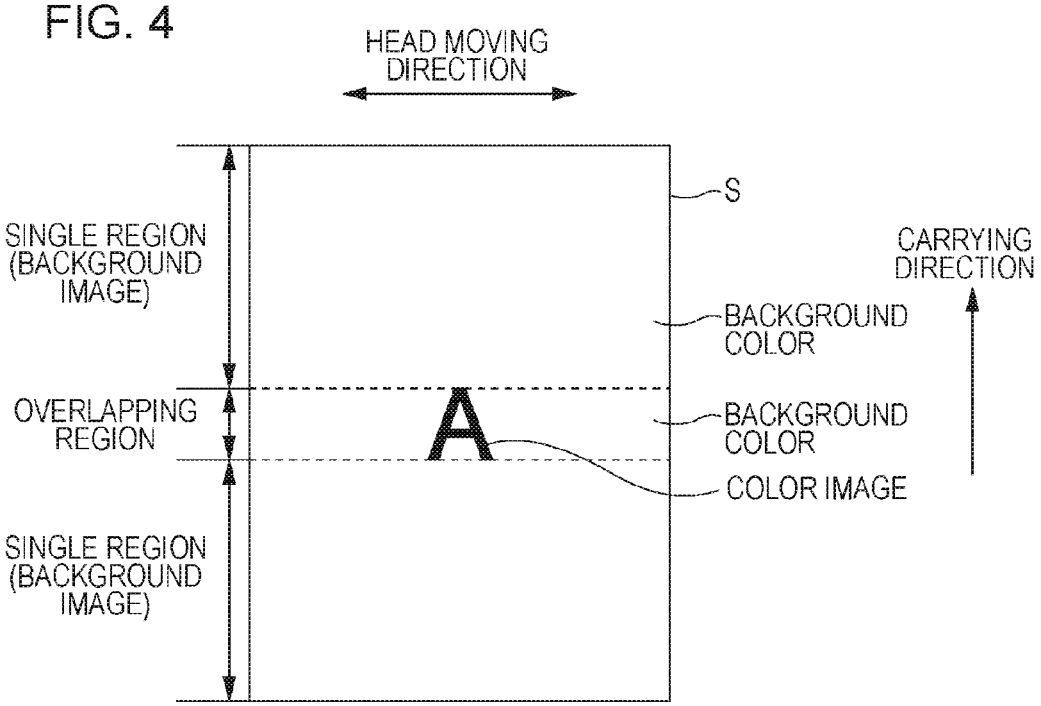
FIG. 4 is a schematic diagram illustrating a single region and an overlapping region in this embodiment.

FIG. 4 illustrates a single region and an overlapping region in this embodiment. FIG. 4 shows a medium S and the single region and the overlapping region on the medium S. The single region represents a region where any one of a background image and a color image is formed. The overlapping region represents a region where both a background image and a color image are formed. Here, the regions may be divided with respect to the transporting direction. Since the head forms such an image by ejecting ink while moving in a direction crossing the transporting direction, the region may be divided with respect to the transporting direction as described above.

The background image is formed by, for example, white ink or metallic color ink. The color image is formed by, for example, cyan, magenta, yellow and black inks. The background image may be toned by mixing the white color with a slight amount of another color.

FIG. 4 shows that a letter "A" is printed as a color image, but the region where the color image exists with respect to the transporting direction is an overlapping region. Meanwhile, a region where a color image does not exist with respect to the transporting direction but only a background image is formed is a single region.

In addition, though FIG. 4 shows the region where only a background color is formed as the single region and shows that a color image is formed on the background color, it is also possible that only a color image is formed as the single region and that a color image is formed earlier and then a background image is formed thereon as an overlapping region.

In this embodiment, the nozzles of the head 41 are used as described below so that the single region printing and the overlapping region printing are switched (hereinafter, referred to switching printing) between when one medium is printed.

First Switching Pattern

Figure 5A:
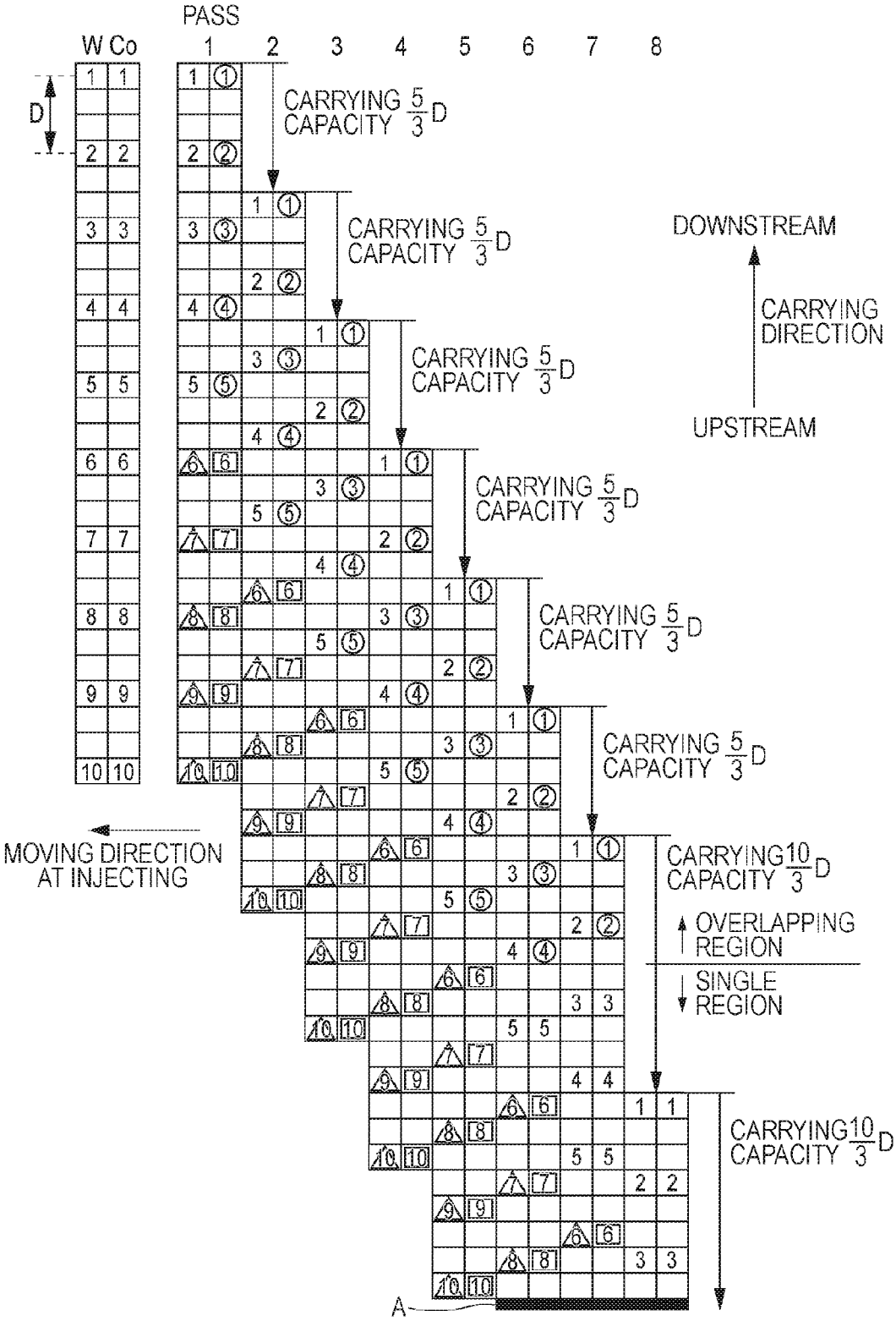
FIG. 5A is a first schematic diagram illustrating a first switching pattern.
Figure 5B:
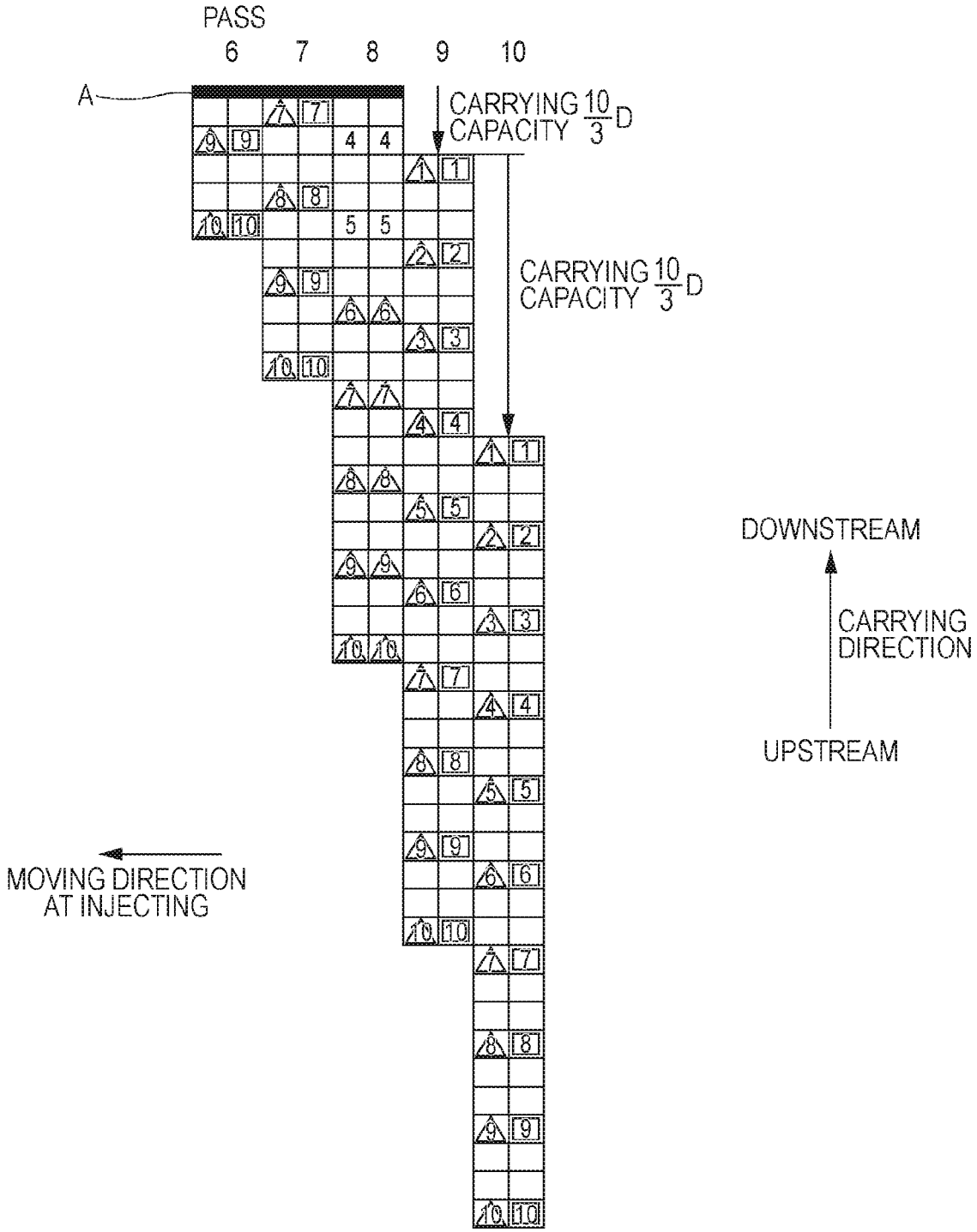
FIG. 5B is a second schematic diagram illustrating the first switching pattern.

FIG. 5A is a first schematic diagram illustrating the first switching pattern, and FIG. 5B is a second schematic diagram illustrating the first switching pattern. The switching pattern shown in FIGS. 5A and 5B should be depicted on one paper, but this pattern is divided into two figures due to the small size of the paper. FIGS. 5A and 5B are coupled at thick lines designated by the symbol A. By referring to both figures, the overall view (1 of the same) of the first switching pattern is completed.

In the figure, a head with a nozzle pitch D is shown. In addition, since the figure is illustrated simplified, the number of nozzles belonging to one nozzle row is reduced to 10. Moreover, nozzle rows respectively ejecting four-color inks (YMCK) are arranged and indicated as a "color nozzle row Co". Further, in the figure, the transporting direction of the medium is shown so that the relative transporting amount of the head with respect to the medium is depicted. The movement direction of the head when ejecting ink (movement direction when ejecting) is directed from the right side to the left side on the paper.

In addition, when showing each pass, the nozzle number used in each pass is surrounded by a circle, a triangle or a rectangle. Each symbol has the following meanings:

Circle: a nozzle that forms a color image in an overlapping region;

Triangle: a nozzle that forms a background image in an overlapping region; and

Rectangle: a nozzle that forms a color image in a single region.

In the single region, a nozzle surrounded by a triangle does not eject ink.

If printing is performed in accordance with the above conditions, when a single region is printed, a color image is printed by using both an upstream color nozzle row (nozzle #6 to #10) and a downstream color nozzle row (nozzle #1 to #5).

In addition, in an overlapping region, a background image is formed by an upstream white nozzle row (corresponding to an upstream background color nozzle row, nozzles #6 to #10), and a color image is formed by a downstream color nozzle row (nozzles #1 to #5).

Figure 6A:
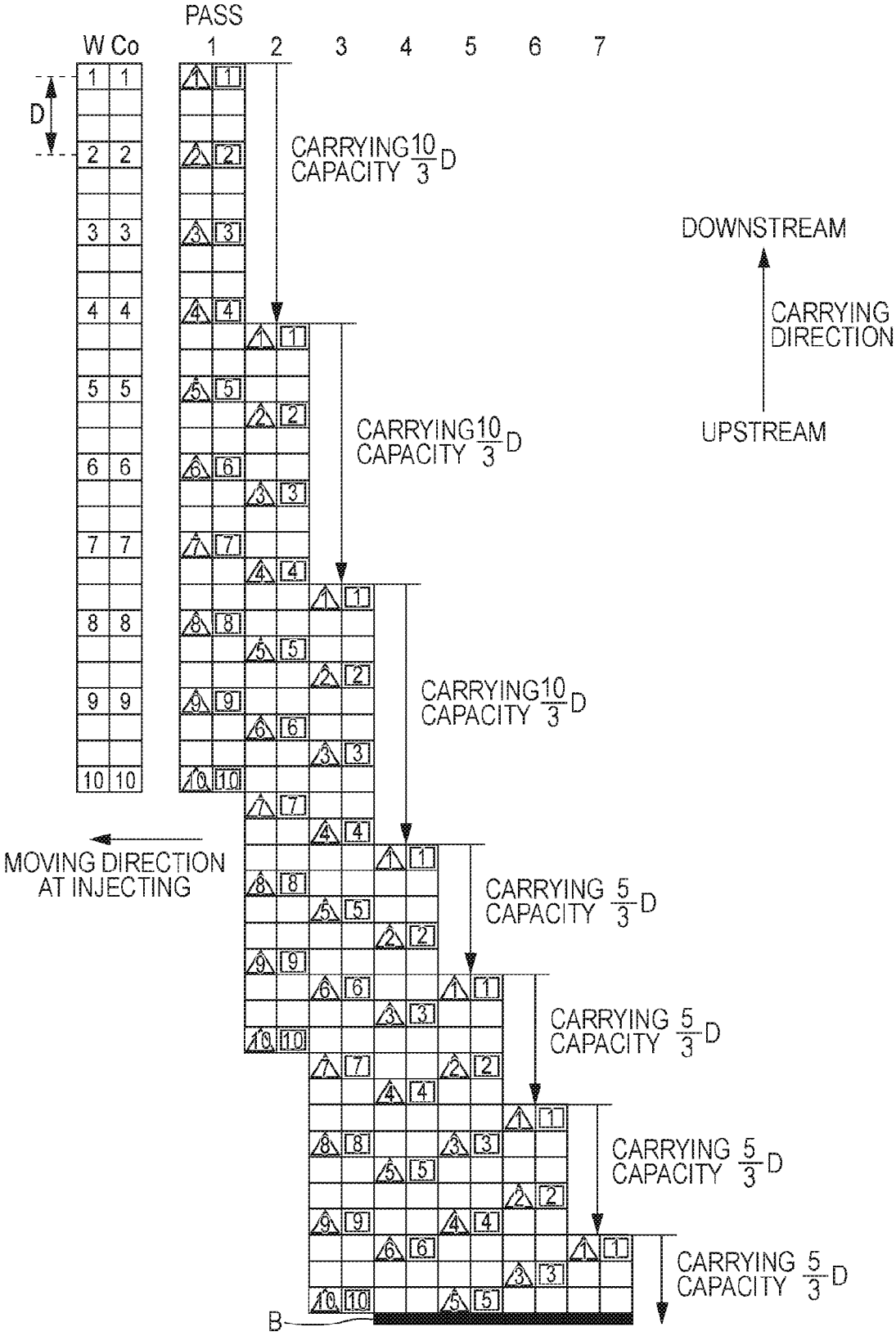
FIG. 6A is a third schematic diagram illustrating the first switching pattern.
Figure 6B:
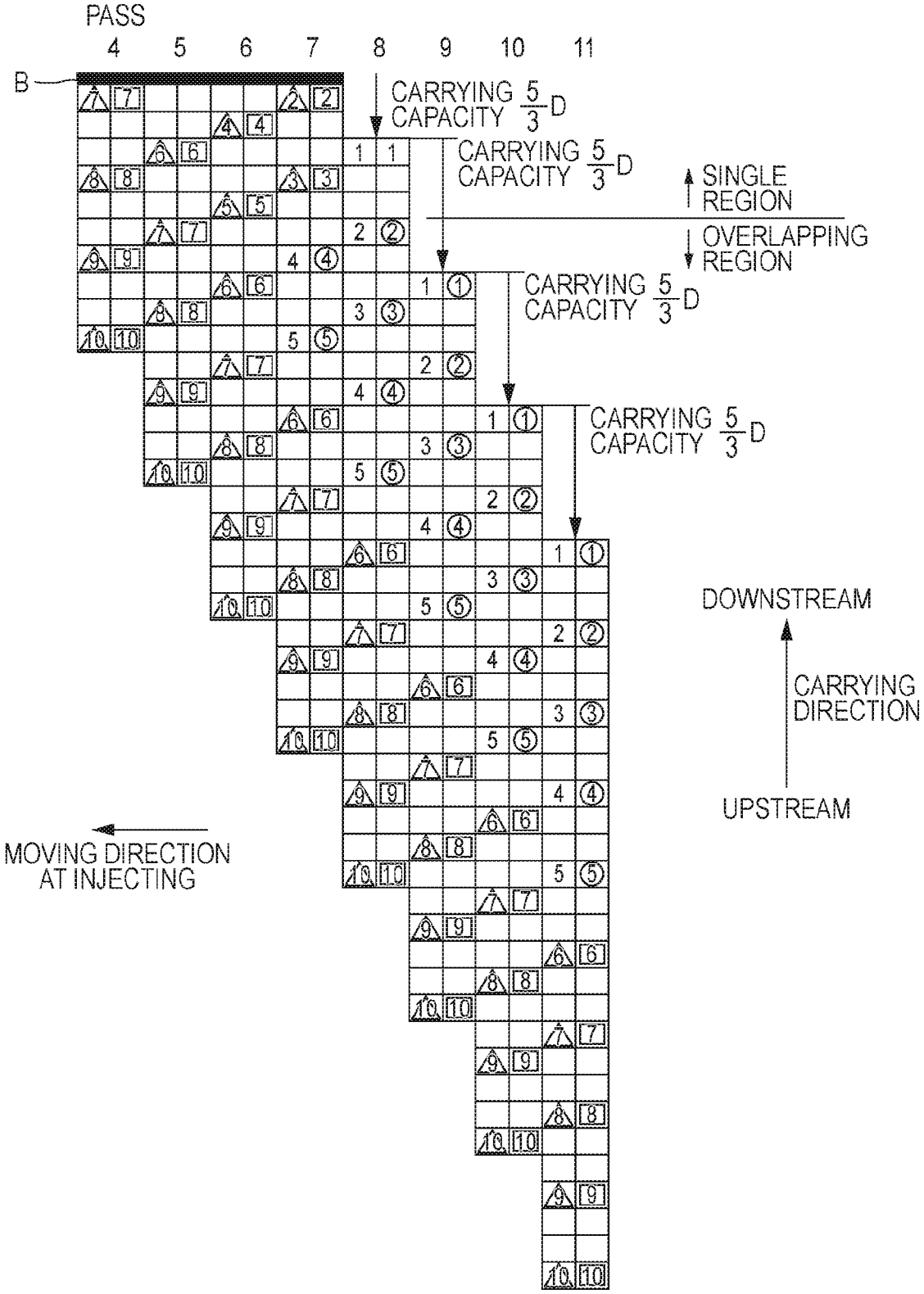
FIG. 6B is a fourth schematic diagram illustrating the first switching pattern.

FIG. 6A is a third schematic diagram illustrating the first switching pattern, and FIG. 6B is a fourth schematic diagram illustrating the first switching pattern. Here, the figures shown in FIGS. 6A and 6B should also be depicted as one, but this pattern is divided into two figures due to the small size of the paper. FIGS. 6A and 6B are also coupled at thick lines designated by the symbol B. By referring to both figures, the overall view (2 of the same) of the first switching pattern is completed.

FIGS. 5A and 5B illustrate a switching from an overlapping region printing to a single region printing. FIGS. 6A and 6B illustrate a switching from a single region printing to an overlapping region printing. Each symbol used in FIGS. 6A and 6B has the same meaning as in FIGS. 5A and 5B.

As described, the single region printing may be switched to the overlapping region printing by performing a printing work as shown in the first switching pattern. In addition, the overlapping region printing may also be switched to the single region printing.

Figure 7:
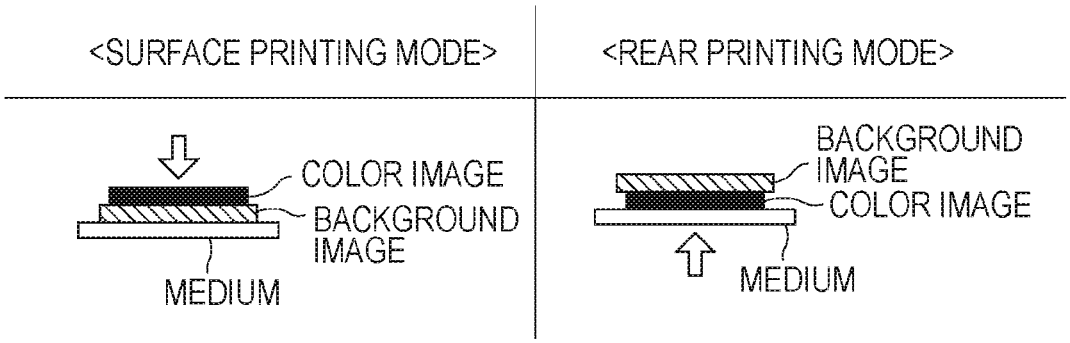
FIG. 7 is a schematic view illustrating printing modes in this embodiment.

FIG. 7 is a schematic diagram illustrating a printing mode in this embodiment. The printer 1 may form an image on a medium by using any one mode between a "front printing mode" in which a color image is printed so that the color image is watched from a printing surface and a "rear printing mode" in which a color image is printed so that the color image is watched from the medium (an opposite side to the image forming side). In the above first switching pattern, the overlapping region is being printed in the front printing mode.

If the rear printing mode is performed, a color image may be formed first by, for example, reversing the movement direction (that is, the direction from the left side to the right side of the paper) at ejecting so that a background image is formed thereon.

In addition, though it has been described that a color image is printed in the single region, it is also possible to form only a background image in the single region by using the nozzles designated by the triangular symbol.

Regarding Tone

If a background image is printed by using only white ink, the color of the white ink used for printing the background image will become the color of the background image. However, although there are "white inks" called with the same name, the shade of white varies depending on the material or the like of the ink. For this reason, the white ink used may make the background image be printed with a color not desired by a user. In addition, depending on the printed matters, a background image with a small amount of chromatic color, instead of a simple white color, may be desired. Further, in a case where a white medium is used, the sense of color white is slightly varying depending on the kind of the medium. For this reason, when printing a background image on a white medium, if the white color of the background image is different from a white color of the medium, the background image may stand out.

Here, a background image with a desired white color (or, a background image with an adjusted white color) may be printed by suitably using a small amount of the color inks (YMCK) together with white ink. For example, in the embodiment shown in FIGS. 5A and 5B, when a background image is formed by the upstream white nozzle row (#6 to #10) in the overlapping region, a small amount of ink is also discharged from an adjacent upstream color nozzle row (#6 to #10). If a background image is printed with white ink and color ink as described above, in a case where the white ink has a slight color, the background image may become a substantially neutral color by printing the background image with ink that achromatizes the color.

Figure 8:
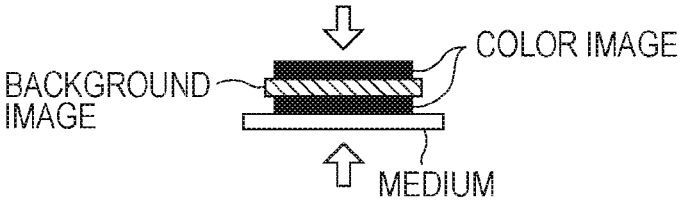
FIG. 8 is a schematic view illustrating double-sided printing.

FIG. 8 illustrates a double-sided printing. When printing the above overlapping region, a color image is formed with respect to one surface of the background image. However, by printing a color image on the other surface, it is possible to print more information. In order to perform such double-sided printing, the nozzles of the head 41 may be used as described below.

Second Switching Pattern

Figure 9A:
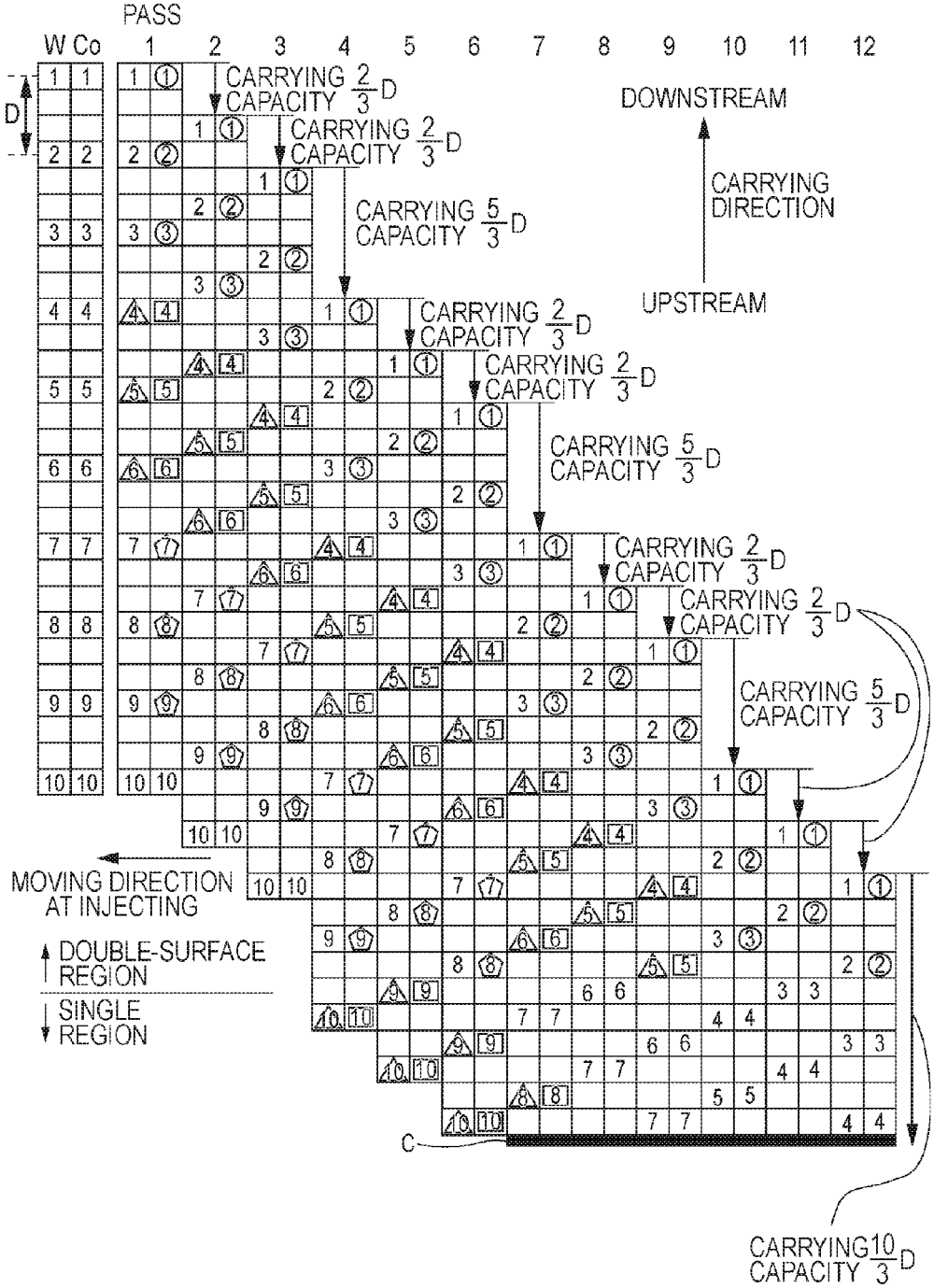
FIG. 9A is a first schematic diagram illustrating a second switching pattern.
Figure 9B:
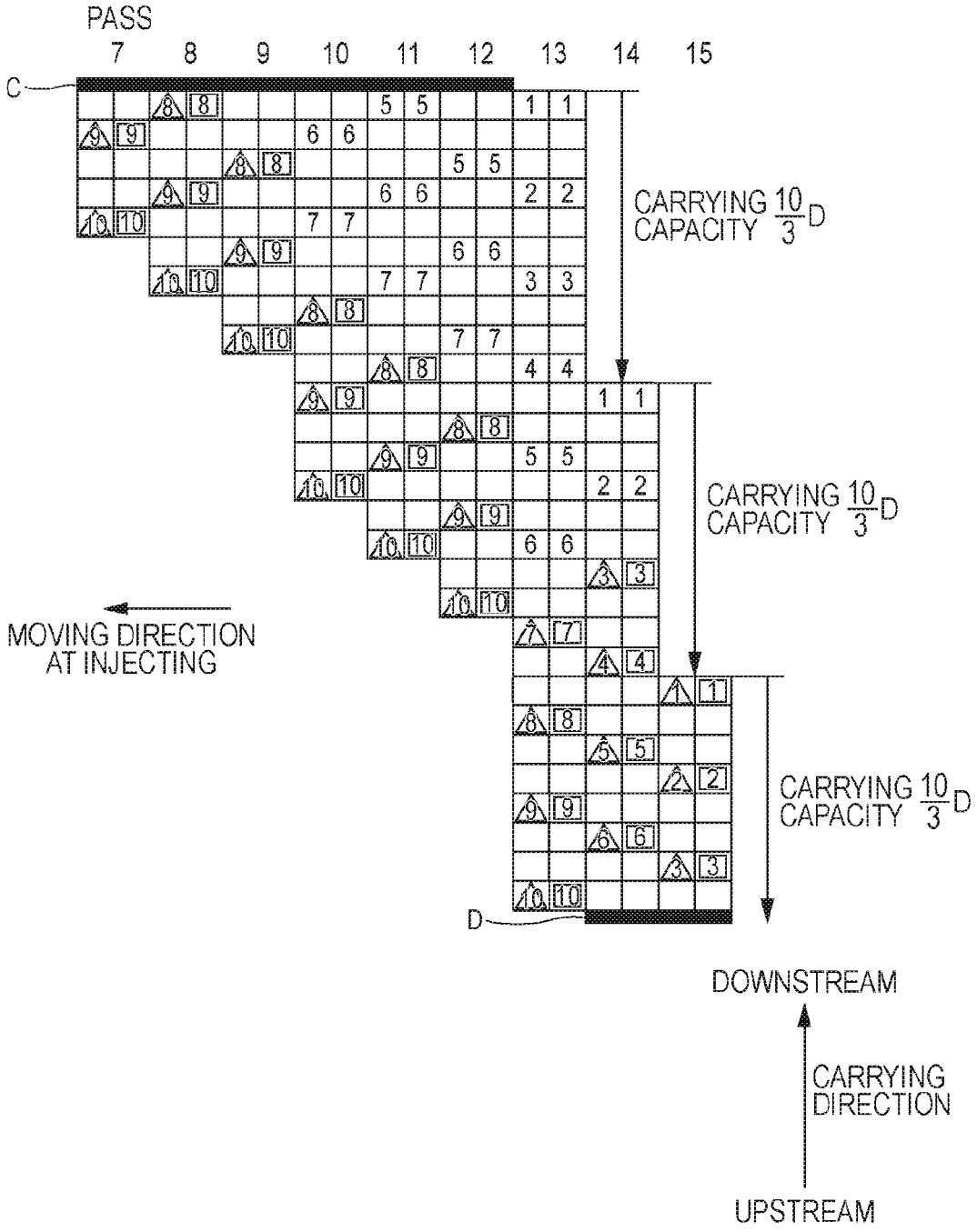
FIG. 9B is a second schematic diagram illustrating the second switching pattern.
Figure 9C:
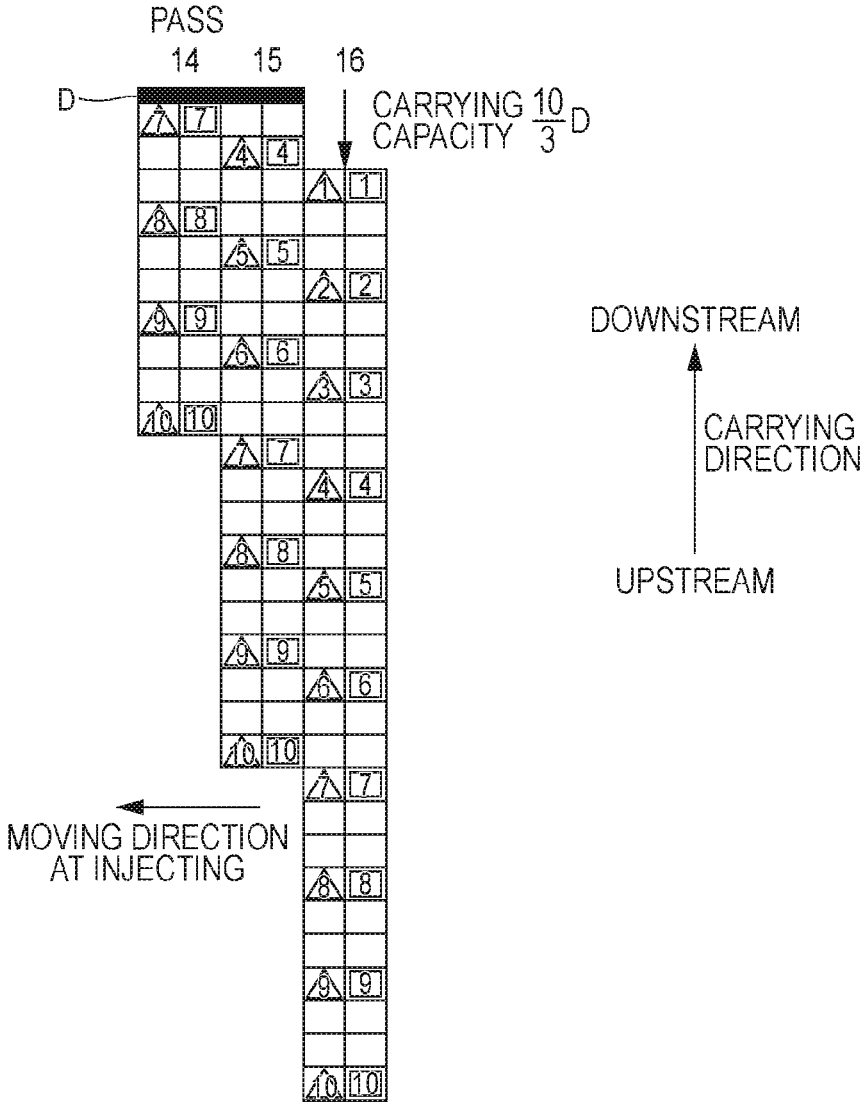
FIG. 9C is a third schematic diagram illustrating the second switching pattern.

FIG. 9A is a first schematic diagram illustrating a second switching pattern, FIG. 9B is a second schematic diagram illustrating the second switching pattern, and FIG. 9C is a third schematic diagram illustrating the second switching pattern. FIGS. 9A, 9B and 9C should be depicted as one, but this pattern is divided into three figures due to the small size of the paper. FIGS. 9A and 9B are respectively coupled at thick lines designated by the symbol C, and FIGS. 9B and 9C are respectively coupled at thick lines designated by the symbol D. By referring to both figures, the overall view (1 of the same) of the second switching pattern is completed.

Here, since the figure is illustrated simplified, the number of nozzles belonging to one nozzle row is reduced to 10. In addition, the overlapping region in the former embodiment is illustrated as a double-sided region in this embodiment. Further, when showing each pass, the nozzle number used in each pass is surrounded by a circle, a triangle, a rectangle and a pentagon. Each symbol has the following meanings:

Circle: a nozzle that forms a color image (surface) on a double-sided region;

Triangle: a nozzle that forms a background image in a double-sided region;

Rectangle: a nozzle that forms a color image in a single region; and

Pentagon: a nozzle that forms a color image (an opposite surface) in a double-sided region.

In the single region, a nozzle surrounded by a triangle does not eject ink.

Figure 10A:
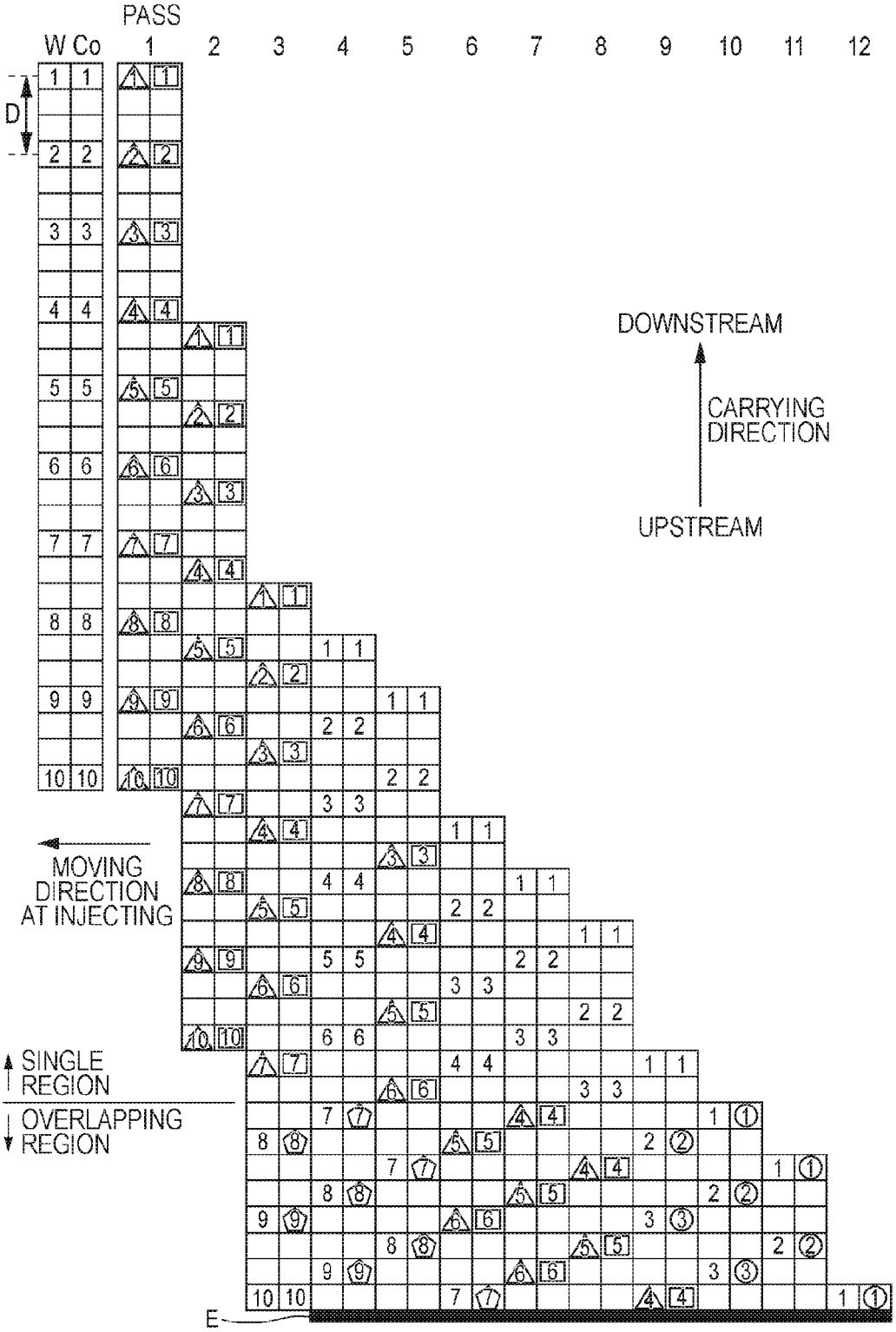
FIG. 10A is a fourth schematic diagram illustrating the second switching pattern.
Figure 10B:
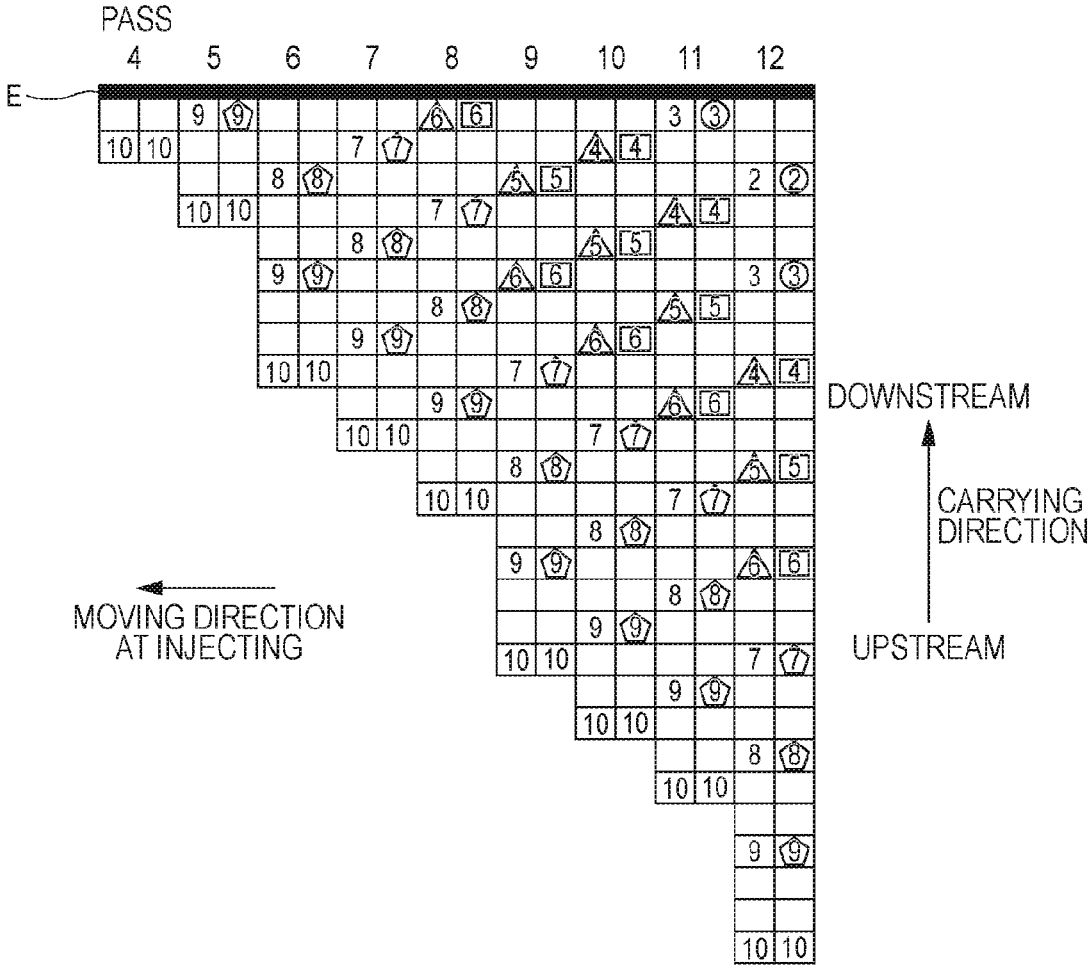
FIG. 10B is a fifth schematic diagram illustrating the second switching pattern.

FIG. 10A is a fourth schematic diagram illustrating the second switching pattern, and FIG. 10B is a fifth schematic diagram illustrating the second switching pattern. FIGS. 10A and 10B are also coupled at thick lines designated by the symbol E. By referring to both figures, an overall figure. (2 of the same) of the second switching pattern is completed.

*Figs*. 9A to 9C illustrates the switching from a double-sided region printing to a single region printing. However, FIGS. 10A and 10B illustrates the switching from a single region printing to a double-sided region printing. Each symbol used in FIGS. 10A and 10B has the same meaning as in FIGS. 9A to 9C.

As described above, by performing a printing work as in the second switching pattern, it is possible to switch from the double-sided region printing to the single region printing. In addition, it is also possible to switch from the single region printing to the double-sided region printing.

In the double-sided region, the quality of the color image is prioritized in comparison to the performance of recording during feeding the double-sided printing. As a result, at switching, some nozzles do not perform recording in the single region. This is because nozzles may pass twice when moving along the same raster. In this embodiment, nozzles firstly touching the raster may perform the recording, but it is also possible that nozzles touching the raster later may perform the recording. In addition, one raster may be recorded with nozzles two times by thinning out pixels, which is so-called an overlapping printing.

In addition, when printing the double-sided region, an overlapping region on one surface may be printed by eliminating data of any one of a color image formed on the surface and a color image formed on the opposite surface. Thus, in a case where the double-sided region is close to (mixed with) an overlapping region on one surface, if the double-sided region is printed, it is possible to correspond to both of the double-sided region and the overlapping region.

Other Embodiments

The above embodiment has been illustrated with the upstream nozzle row and the downstream nozzle row in one head, but the number of head is not limited to one. For example, it is possible to provide a first head at an upstream and also provide a second head at a downstream. Each head has a color ink nozzle row and a white ink nozzle row. Even in this case, the color ink nozzle row and the white nozzle row of the first head may be set as an upstream nozzle row, and the color ink nozzle row and the white nozzle row of the second head may be set to a downstream nozzle row.

Though it has been illustrated in the above embodiment that the printer 1 is the printing apparatus, the printing apparatus may also be realized as a liquid discharging device for ejecting or discharging a fluid (a liquid, a liquid material where particles of functional material are dispersed, or a fluid body such as gel) other than ink, without being limited to the above. For example, the technique illustrated in the above embodiment may be applied to various kinds of devices that adopt an ink jet technique, such as a color filter production device, a dying device, a micromachining device, a semiconductor manufacturing device, a surface processing device, a three-dimensional molding machine, a gas evaporator machine, an organic EL manufacturing device (particularly, a polymer EL manufacturing device), a display manufacturing device, a film forming device, a DNA chip production device, and so on. Such methods and producing methods are within the scope of the invention.

The above embodiments are for facilitating understanding of the invention and not intended to limit the invention. The invention may be changed or modified without departing from the spirit thereof, and it is obvious that the invention includes its equivalents.

Regarding Head

In the above embodiments, the ink is discharged by using a piezoelectric element. However, the method for discharging a liquid is not limited thereto. For example, other methods such as forming bubbles in a nozzle through heating may be used.

What is claimed is:

1. A printing apparatus, comprising:

(A) a transporting unit for transporting a medium in a transporting direction;

(B) an upstream background color nozzle row in which background color nozzles for ejecting background ink to the medium are arranged;

(C) an upstream color nozzle row in which color nozzles for ejecting color ink to the medium are arranged;

(D) a downstream background color nozzle row located downstream of the upstream background color nozzle row in the transporting direction;

(E) a downstream color nozzle row in which the color nozzles located downstream of the upstream color nozzle row in the transporting direction;

(F) a moving unit for moving the upstream background color nozzle row, the upstream color nozzle row, the downstream background color nozzle row and the downstream color nozzle row in an intersecting direction that crosses the transporting direction;

(G) a controller for printing of an image having a single region and an overlapping region by performing a single region printing for the single region and an overlapping region printing for the overlapping region during printing when one image is being printed, wherein, the single region printing is printing that forms a background image with at least one of the upstream background color nozzle row and the downstream background color nozzle row, or forms a color image with at least one of the upstream color nozzle row and the downstream color nozzle row, wherein, the overlapping region printing is printing that forms a background image with the upstream background color nozzle row and forms a color image with the downstream color nozzle row, or forms a color image with the upstream color nozzle row and forms a background image with the downstream background color nozzle row.

2. The printing apparatus according to claim 1, wherein the overlapping region printing includes printing modes comprising:

a background image pre-printing mode in which the background color ink lands on the medium and then the color ink lands on the medium; and a background image post-printing mode in which the color ink lands on the medium and then the background color ink lands on the medium.

3. The printing apparatus according to claim 2, wherein, in the background image post-printing mode, after the background color ink lands on the medium, the color ink lands on the medium one more time.

4. The printing apparatus according to claim 1, wherein, during the movement in the intersecting direction, ink is ejected in any one of an advancing direction and a returning direction.

5. The printing apparatus according to claim 1, wherein the background color ink is white ink.

6. The printing apparatus according to claim 1, wherein the background color ink is metallic color ink.

7. The printing apparatus according to claim 1, wherein the controller mixes the background color ink and the color ink to tone the background image.

8. The printing apparatus according to claim 1, wherein the controller switches between the single region printing and the overlapping region printing during printing when one image is being printing.

9. The printing apparatus according to claim 1, wherein the single region and the overlapping region are regions in the transporting direction.

10. The printing apparatus according to claim 1, wherein the single region and the overlapping region are formed during one moving operation of the head in the intersecting direction.

11. The printing apparatus according to claim 1, wherein the background image is formed by both the background ink ejected from the background color nozzles and the color ink ejected from the color nozzles.

* * * * *